US010247132B2

(12) United States Patent
Salenbien et al.

(10) Patent No.: US 10,247,132 B2
(45) Date of Patent: Apr. 2, 2019

(54) PISTON WITH SEALED COOLING GALLERY AND METHOD OF CONSTRUCTION THEREOF

(71) Applicant: Federal-Mogul Corporation, Southfield, MI (US)

(72) Inventors: Gregory Salenbien, Britton, MI (US); Miguel Azevedo, Ann Arbor, MI (US)

(73) Assignee: Tenneco Inc., Lake Forest, IL (US)

( * ) Notice: Subject to any disclaimer, the term of this patent is extended or adjusted under 35 U.S.C. 154(b) by 39 days.

(21) Appl. No.: 15/011,852

(22) Filed: Feb. 1, 2016

(65) Prior Publication Data

US 2016/0222911 A1 Aug. 4, 2016

Related U.S. Application Data

(60) Provisional application No. 62/110,191, filed on Jan. 30, 2015.

(51) Int. Cl.

| | |
|---|---|
| ***F02F 3/18*** | (2006.01) |
| ***F02F 3/16*** | (2006.01) |
| ***F02F 3/00*** | (2006.01) |

(52) U.S. Cl.

CPC ..... *F02F 3/18* (2013.01); *F02F 3/003* (2013.01); *F02F 3/16* (2013.01); *F02F 2003/0061* (2013.01)

(58) Field of Classification Search

CPC ..... F02F 3/18; F02F 3/003; F02F 3/16; F02F 2003/0061

See application file for complete search history.

(56) References Cited

U.S. PATENT DOCUMENTS 1,953,109 A * 4/1934 Heron ..... F02F 3/18 123/193.6
2,537,174 A 12/1948 Townhill
(Continued)

FOREIGN PATENT DOCUMENTS

CN 103890364 A 6/2014
DE 1801792 A1 8/1969
(Continued)

OTHER PUBLICATIONS

International Search Report, dated Apr. 18, 2016 (PCT/US2016/015906).

(Continued)

*Primary Examiner* — Jacob Amick
(74) *Attorney, Agent, or Firm* — Robert L. Stearns; Dickinson Wright, PLLC

(57) ABSTRACT

A piston for an internal combustion engine and method of construction thereof is provided. The piston has a piston body including an upper part and a lower part. The upper part has an upper combustion surface configured for direct exposure to combustion gases within a cylinder bore with an undercrown surface beneath the upper combustion surface. The body has a ring belt region configured for receipt of at least one piston ring adjacent the upper combustion surface with an annular cooling gallery configured radially inwardly from the ring belt region. The cooling gallery has a floor, wherein the floor has at least one through opening. A coolant medium is disposed in the cooling gallery, and a sealing member is disposed in the at least one through opening to seal off the coolant medium in the coolant gallery.

23 Claims, 4 Drawing Sheets

(56) References Cited

U.S. PATENT DOCUMENTS

| | | | | |
|---|---|---|---|---|
| 2,882,106 | A | 4/1959 | Meurer | |
| 3,181,514 | A | 5/1965 | Druzynski | |
| 3,189,010 | A | 6/1965 | Isley | |
| 3,413,897 | A | 12/1968 | Atkin | |
| 3,464,100 | A | 9/1969 | Foulet | |
| 3,485,143 | A | 12/1969 | Canady | |
| 3,516,335 | A | 6/1970 | Fangman | |
| 5,816,607 | A * | 10/1998 | Bugdaci | B60R 21/2171 280/728.2 |
| 6,904,876 | B1 | 6/2005 | Hofbauer et al. | |
| 8,042,512 | B2 | 10/2011 | Scharp | |
| 8,443,716 | B2 | 5/2013 | Keller | |
| 8,899,208 | B2 | 12/2014 | Bischofberger | |
| 2010/0147250 | A1 | 6/2010 | Boczek et al. | |
| 2011/0267080 | A1 * | 11/2011 | Hedges | G01N 33/2888 324/698 |
| 2013/0146017 | A1 * | 6/2013 | Muscas | B23P 15/10 123/193.6 |
| 2014/0123930 | A1 | 5/2014 | Lineton et al. | |
| 2014/0295259 | A1 * | 10/2014 | Nakayama | F16B 19/008 429/185 |
| 2015/0075455 | A1 | 3/2015 | Bischofberger | |

FOREIGN PATENT DOCUMENTS

| | | | |
|---|---|---|---|
| FR | 647110 | A | 11/1928 |
| JP | 58190538 | | 12/1983 |
| JP | 61187944 | U | 11/1986 |
| JP | S61187944 | U | 11/1986 |
| WO | 2014071274 | A1 | 5/2014 |

OTHER PUBLICATIONS

International Search Report dated Apr. 18, 2016 regarding PCT/US2016/015906.

* cited by examiner

PISTON WITH SEALED COOLING GALLERY AND METHOD OF CONSTRUCTION THEREOF

CROSS-REFERENCE TO RELATED APPLICATION

This application claims the benefit of U.S. Provisional Application Ser. No. 62/110,191, filed Jan. 30, 2015, which is incorporated herein by reference in its entirety.

BACKGROUND OF THE INVENTION

1. Technical Field

This invention relates generally to internal combustion engines, and more particularly to pistons and their method of construction.

2. Related Art

Engine manufacturers are encountering increasing demands to improve engine efficiencies and performance, including, but not limited to, improving fuel economy, improving fuel combustion, reducing oil consumption, and increasing the exhaust temperature for subsequent use of the heat within the vehicle. In order to achieve these goals, the engine running temperature in the combustion chamber needs to be increased. However, while desirable to increase the temperature within the combustion chamber, it remains necessary to maintain the piston at a workable temperature. As such, it is known to incorporate outer and inner cooling galleries, both open and closed, within the piston head through which engine oil is circulated to reduce the operating temperature of the piston head. The outer cooling galleries typically circulate about an upper land of the piston including a ring groove region while the inner cooling gallery is typically beneath an upper combustion surface of the piston head, commonly referred to as undercrown, which commonly includes a recessed combustion bowl. As such, both the ring belt region and the combustion surface benefit from cooling action of the circulated oil. Wherein a closed cooling gallery is provided, it is known to cast closed cooling galleries; however, the manufacturing process tends to be costly.

A piston constructed in accordance with this invention overcomes the aforementioned disadvantages associated with pistons having a closed cooling gallery.

SUMMARY OF THE INVENTION

In accordance with one aspect of the invention, a piston for an internal combustion engine is provided. The piston includes a piston body including an upper part and a lower part. The upper part has an upper combustion surface configured for direct exposure to combustion gases within a cylinder bore with an undercrown surface beneath the upper combustion surface. The body has a ring belt region configured for receipt of at least one piston ring adjacent the upper combustion surface with an annular cooling gallery configured radially inwardly from the ring belt region. The cooling gallery has a floor, wherein the floor has at least one through opening. A coolant medium is disposed in the cooling gallery, and a sealing member is disposed in the at least one through opening to seal the coolant medium in the coolant gallery.

In accordance with another aspect of the invention, the sealing member is a non-threaded sealing member.

In accordance with another aspect of the invention, the sealing member is a threaded sealing member.

In accordance with another aspect of the invention, the sealing member can be provided having a tapered threaded shank to facilitate threading the sealing member in a tapered through opening of the cooling gallery floor.

In accordance with another aspect of the invention, the sealing member can be fixed to an underside of the floor via a friction weld joint.

In accordance with another aspect of the invention, the sealing member can be provided having a conically tapered joining surface to facilitate forming a friction weld joint.

In accordance with another aspect of the invention, the sealing member can be provided as a rivet.

In accordance with another aspect of the invention, the sealing member has a plastically expanded portion closing off the through opening in the floor.

In accordance with another aspect of the invention, the sealing member can be press-fit in the through opening.

In accordance with another aspect of the invention, a sealant material can be disposed about an outer periphery of the sealing member.

In accordance with another aspect of the invention, the sealant material can be provided as a high temperature anaerobic sealant material.

In accordance with another aspect of the invention, a method of constructing a piston for an internal combustion engine is provided. The method includes forming a piston body having an upper combustion surface configured for direct exposure to combustion gases within a cylinder bore and an undercrown surface beneath the upper combustion surface; forming a ring belt region configured for receipt of at least one piston ring adjacent the upper combustion surface; forming an annular cooling gallery radially inwardly from the ring belt region; forming a through opening in a floor of the cooling gallery; disposing a coolant medium in the cooling gallery through the through opening; and disposing a sealing member in the through opening to close off the through opening and seal the coolant medium in the cooling gallery.

In accordance with another aspect of the invention, the method can further include providing the sealing member as a non-threaded sealing member.

In accordance with another aspect of the invention, the method can further include plastically expanding a portion of the sealing member to close off and seal the through opening in the floor.

In accordance with another aspect of the invention, the method can further include friction welding the sealing member to an underside of a floor of the cooling gallery.

In accordance with another aspect of the invention, the method can further include providing the sealing member as a rivet and expanding the rivet in the through opening.

In accordance with another aspect of the invention, the method can further include providing the sealing member as a plug and pressing the plug in the through opening.

In accordance with another aspect of the invention, the method can further include disposing a sealant material about an outer periphery of the plug prior to pressing the plug in the through opening.

In accordance with another aspect of the invention, the method can further include providing the sealant material as a high temperature resistant, anaerobic sealant material.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
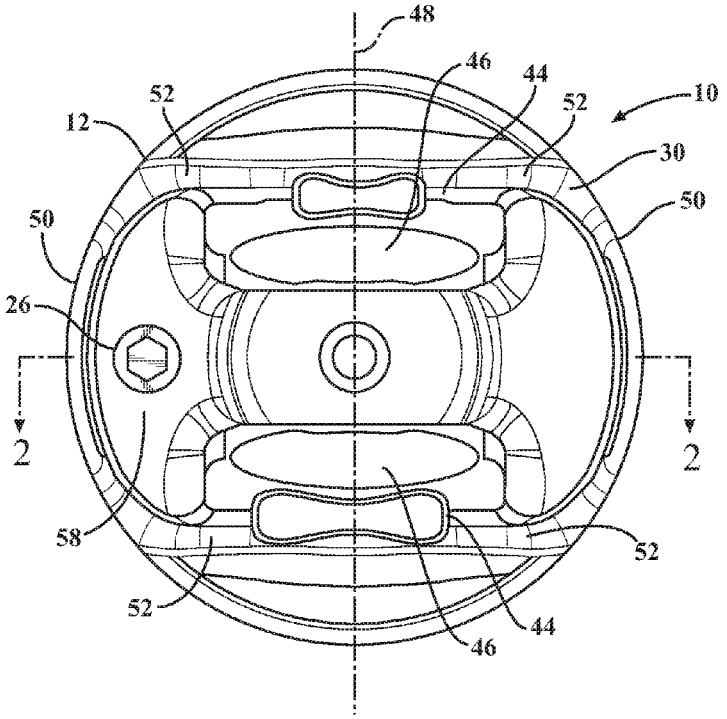
FIG. 1 is a bottom view of a piston constructed in accordance with one aspect of the invention.
Figure 2:
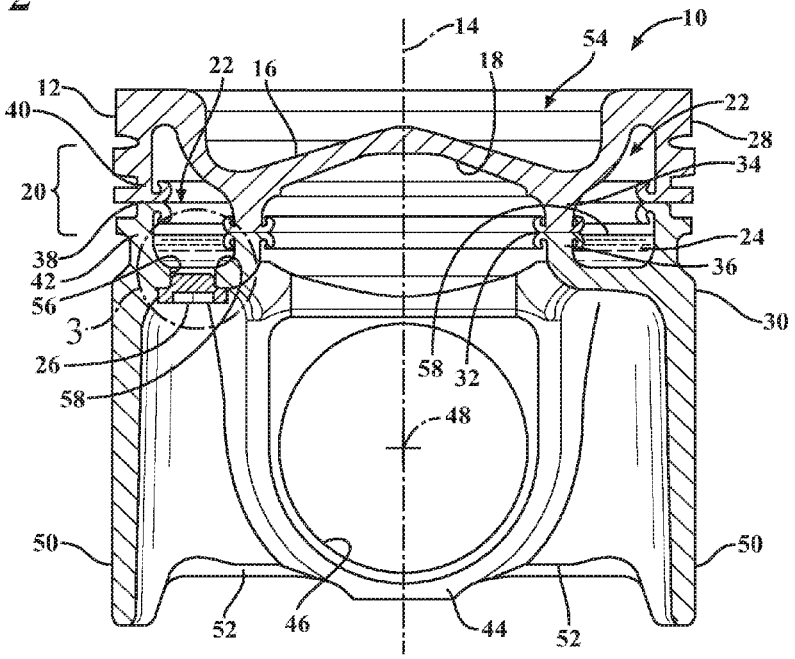
FIG. 2 is a cross-sectional view taken generally along line 2-2 of the piston of FIG. 1.

Referring in more detail to the drawings, FIGS. 1 and 2 illustrate a piston assembly, referred to hereafter simply as piston 10, constructed according to one presently preferred embodiment of the invention, for reciprocating movement in a cylinder bore or chamber of an internal combustion engine (not shown), such as light vehicle diesel, mid-range diesel, heavy duty and large bore diesel engines, and gas engines, for example. The piston 10 has a piston body 12 extending along a central longitudinal axis 14 along which the piston 10 reciprocates in the cylinder bore. The body 12 is formed including an upper combustion wall having on one side an upper combustion surface 16 configured for direct exposure to combustion gases within a cylinder bore and on an opposite side an undercrown surface 18 located directly and axially beneath the upper combustion surface 16. The piston body 12 is also formed having a ring belt region 20 depending from the upper combustion surface 16 adjacent the upper combustion surface 16 wherein the ring belt region 20 is configured for receipt of at least one piston ring (not shown), as is known. Further, the piston body 12 is constructed having an annular, closed and sealed cooling gallery 22 with a coolant medium 24 sealed therein for the life of the piston 10. The cooling gallery 22 is shown as being toroid-shaped and configured radially inwardly and in substantial radial alignment with the ring belt region 20, by way of example and without limitation. Upon disposing the coolant medium 24 within the cooling gallery 22, the cooling gallery 22 is sealed off and maintained as a hermetically sealed cooling gallery by a sealing member 26, thereby assuring the coolant medium 24 is contained within the cooling gallery 22 and prevented from leaking outwardly therefrom past the sealing member 26.

The piston body 12 is shown having a steel upper part 28 and a steel lower part 30 constructed from separate pieces of steel material and subsequently fixed to one another via a welding process, such as induction welding, resistance welding, charge carrier rays, electron beam welding, laser welding, stir welding, brazing, soldering, hot or cold diffusion, and shown as a friction welding process, though other joining processes are contemplated to be within the scope of the invention. In the embodiment shown, a first bond joint 32 joins a pair of annular inner ribs 34, 36 to one another, and in addition, a second bond joint 38 extends through an outer wall within the ring belt region 20 to join a pair of annular outer ribs 40, 42 to one another.

The lower part 30 depends along the central axis 14 from the upper part 28 to provide a pair of pin bosses 44 having laterally spaced pin bores 46 coaxially aligned along a pin bore axis 48 that extends generally transverse to the central longitudinal axis 14. The pin bosses 44 are joined to laterally spaced skirt portions 50 via strut portions 52. The skirt portions 50 are diametrically spaced from one another across opposite sides the pin bore axis 48 and have convex outer surfaces contoured for sliding cooperation within the cylinder bore to maintain the piston 10 in a desired orientation as it reciprocates along the axis 14 through the cylinder bore.

The upper combustion surface 16 is represented as having a recessed combustion bowl 54 to provide a desired gas flow with the cylinder bore. At least in part due to the combustion bowl 54, relatively thin regions of piston body material are formed between the upper combustion surface 16, the annular cooling gallery 22 and the undercrown surface 18. As such, in use, these regions need to be properly cooled via oil flowing through the cooling gallery 22. In accordance with one aspect of the invention, the necessary cooling for this region is provided, at least in part, via coolant medium 24 contained within the cooling gallery 22.

To facilitate disposing the coolant medium 24 into the cooling gallery 22 upon joining the upper part 28 to the lower part 30, the lower part 30 has a through opening 56 formed in a floor 58 of the cooling gallery 22, such as via a drilling process, by way of example and without limitation. The through opening 56 can be formed having a suitable diameter, and in accordance with one example, the diameter was formed between about 8-10 mm, without limitation, and formed as non-threaded through opening. The through opening 56 is shown as being located radially inwardly from a central portion of one of the skirts 50, generally centrally between the pin bores 46, on a non-thrust side of the piston 10, thereby being in a region of reduced stress. To facilitate forming the through opening 56 in the precise, desired location, an identifying feature can be formed in a surface of the floor 58, such as an embossed or coined depression, by way of example and without limitation, while forging or otherwise constructing the lower part 30. Then, upon disposing the desired type and amount of coolant medium 24 through the through opening 56 and into the cooling gallery 22, the cooling gallery 22 is completely closed and sealed off via the sealing member 26 and confined within the cooling gallery 22 in accordance with a further aspect of the invention.

Figure 4A:
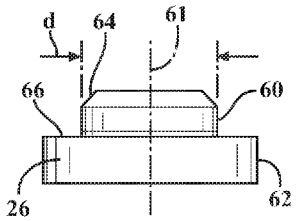
FIG. 4A is an elevation view of a seal plug from the piston of FIG. 1.
Figure 4B:
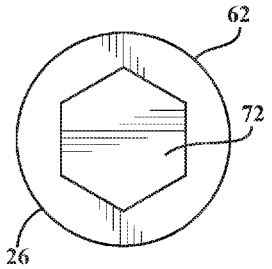
FIG. 4B is top view of the seal plug of FIG. 4A.
Figure 5A:
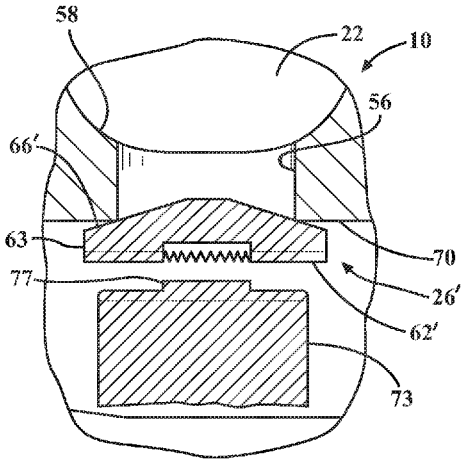
FIG. 5A is a view of a seal plug constructed in accordance with another aspect of the invention shown in a preassembled state.
Figure 5B:
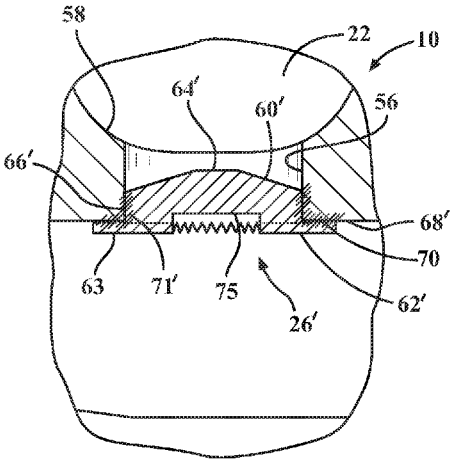
FIG. 5B is a view similar to FIG. 5A showing the seal plug in a fully assembled state.
Figure 6A:
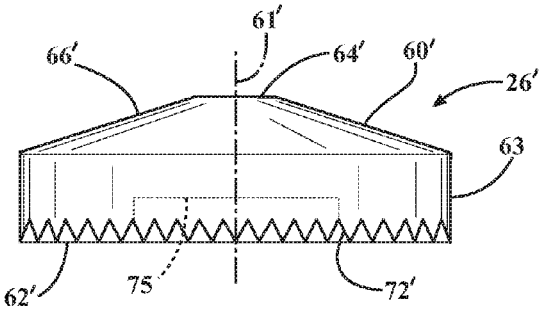
FIG. 6A is an elevation view of the seal plug from the piston of FIGS. 5A and 5B.
Figure 6B:
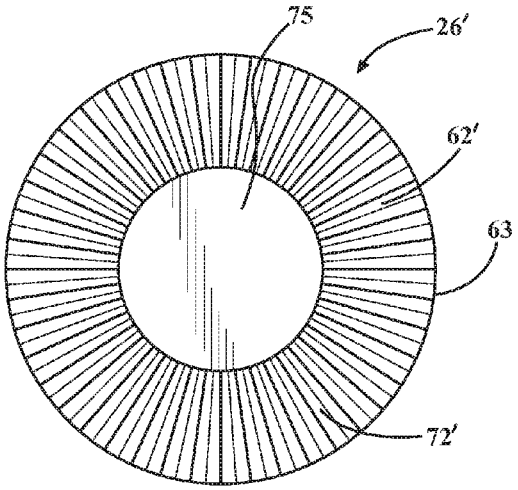
FIG. 6B is top view of the seal plug of FIG. 6A.

In accordance with one aspect of the invention, the sealing member 26 is provided as a non-threaded, steel plug, as best shown in FIGS. 4A-B. The plug 26 has a generally cylindrical stud or shank 60 extending along a central axis 61 and an enlarged head, also referred to as end cap 62. The shank 60 is preferably sized having an outer diameter (d) that is less than the diameter of the through opening 56 in the floor 58 of the cooling gallery 22, and thus, the shank 60, being void of any external male threads, has a clearance fit within the through opening 56 upon being disposed therethrough. As such, there is no need to control tight tolerances between the outer diameter of the shank 60 and the outer periphery of the through opening 56, as there is no interference fit therebetween, and thus, manufacturing efficiencies can be realized. To facilitate locating and centering the shank 60 within the through opening 56, the shank 60 can be formed having a chamfered end 64. The end cap 62 is formed having a planar or substantially planar, annular joining surface 66 extending generally transversely to the axis 61 outwardly from the shank 60. The joining surface 66 extends radially outwardly beyond the through opening 56, thereby presenting the end cap 62 with a diameter that is larger than the diameter of the through opening 56. The joining surface is the portion of the sealing member 26 that is responsible for and directly forms a fixed bond joint with the lower part 30.

Figure 3:
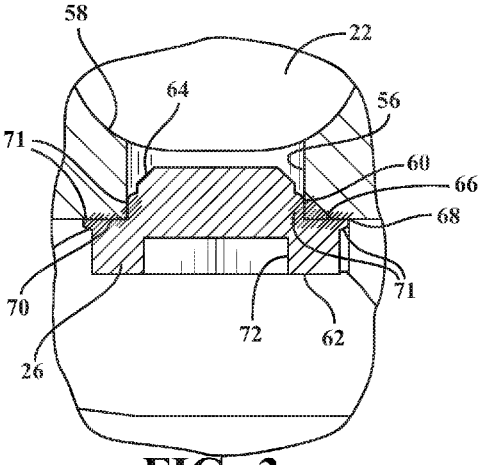
FIG. 3 is an enlarged view of the encircled area 3 of FIG. 2.

Prior to disposing the sealing member 26 in the through opening 56 to be closed and sealed off, as best shown in FIG. 3, a bonding surface 70 on the underside of the floor 58, to which the joining surface 66 of the sealing member 26 is to be fixed, can be machined flat and planar, such as in a spot facing operation, by way of example and without limitation. As such, a good, reliable, gas/fluid leak-proof bond is able to be reliably established between the joining surface 66 and the bonding surface 70. Then, upon forming the smooth, planar bonding surface 70, the shank 60 of the sealing member 26 is disposed within the through opening 56 in a clearance fit therewith, and the sealing member 26 is rotatably driven at a sufficiently high rotational speed to form the bond joint 68 via a friction weld, whereupon flashing 71 is formed to extend radially outwardly from the respective steel joining and bonding surfaces 66, 70 and axially inwardly into the through opening 56, which is accommodated by the clearance fit of the shank 60 within the through opening 56. Accordingly, the flashing 71, being freely permitted to flow into the through opening 56 between the outer periphery of the through opening 56 and the outer surface of the shank 60, automatically facilitates forming the gas/liquid tight seal to hermetically seal off the through opening 56, and thus, no additional bonding agents are needed, thereby further providing manufacturing efficiencies, thus, reducing cost. To facilitate rotatably driving the sealing member 26 at the rotational speed needed to form a friction weld joint, the end cap 62 can be provided with a drive feature 72, shown as a non-circular, hexagonal recessed pocket, by way of example and without limitation, for receipt of a similarly shaped drive tool. It should be recognized that the pocket 72 could take a different; non-circular shaped, as desired, and further, could be formed as a male protrusion, if desired.

In FIGS. 5A-5B and 6A-6B, a sealing member 26' for closing and sealing off a through opening 56 extending into a cooling gallery 22 of a piston (portion of piston 10 illustrated) constructed in accordance with another aspect of the invention is shown, wherein the same reference numerals, offset by a prime symbol ('), are used to identify like features of the sealing member.

The sealing member 26' is provided as a non-threaded, steel plug. The plug 26' has an annular tapered nose 60' extending radially inwardly toward a central axis 61' to a free end 64', wherein the free end 64' is shown to be slightly flattened, by way of example and without limitation. The tapered nose 60' extends radially outwardly away from the central axis 61' to a generally cylindrical sidewall 63, wherein the sidewall 63 extends to an opposite free end 62'. To facilitate rotatably driving the sealing member 26' at the rotational speed needed to form a friction weld joint, the free end 62' can be provided with a drive feature 72', shown as a serrated face, by way of example and without limitation, for receipt of a similarly serrated drive tool 73. To facilitate locating the driving tool 73, a central recessed pocket 75 can be formed in the free end 62' to receive a similarly shaped male protrusion 77 on the driving tool 73. The tapered nose 60' provides a conical joining surface 66' that extends radially outwardly beyond the through opening 56, thereby presenting the sidewall 63 and joining surface 66' with a diameter that is larger than the diameter of the through opening 56. The joining surface 66' is the portion of the sealing member 26' that is responsible for abutting and directly forming a fixed friction welded bond joint 68' with the lower part 30.

In assembly, the tapered nose 60' of the sealing member 26' is disposed within the through opening 56, wherein the conical or frustroconical form of the nose taper facilitates locating and centering the sealing member 26' in the through opening 56. Then, the serrated tool 73 is brought into mating engagement with the serrated drive feature 72', and the sealing member 26' is rotatably driven at a sufficiently high rotational speed to form the bond joint 68' via a friction weld, whereupon the sealing member 26' is caused to sink into the material of the floor 58 as a result of melting material of the floor 58, wherein molten, solidified and hardened flashing 71' is formed to extend radially outwardly from the respective steel joining and bonding surfaces 66', 70 and axially inwardly into the through opening 56, which facilitates forming the strong, gas/liquid tight seal to hermetically seal off the through opening 56, and thus, no additional bonding agents are needed, thereby further providing manufacturing efficiencies, thus, reducing cost. It should be recognized that both the material of the floor 58 and the sealing member 26' can be caused to melt, thereby forming an alloy of molten, solidified material that results in the strong, hardened bond joint.

Figure 7A:
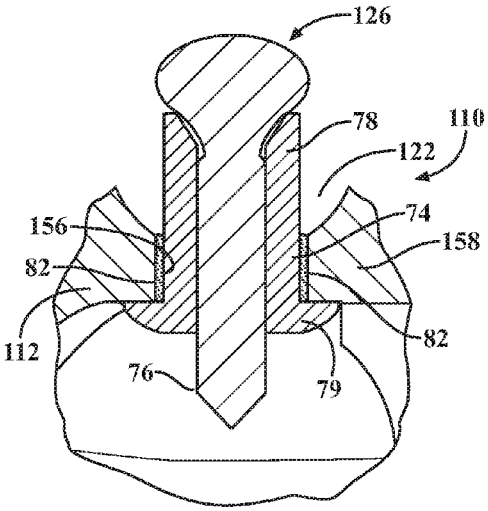
FIG. 7A is a cross-sectional elevation view of a sealing member in accordance with another aspect of the invention shown in a partially installed state.
Figure 7B:
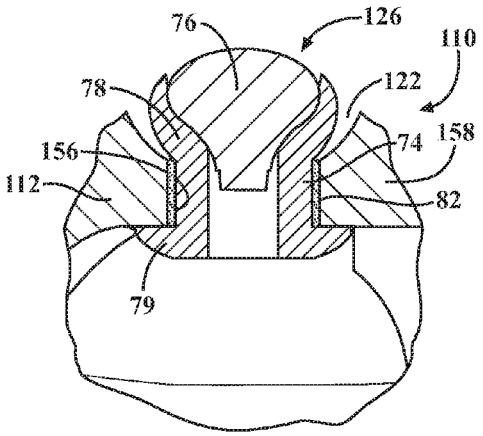
FIG. 7B is a cross-sectional elevation view of the sealing member of FIG. 7A shown in a fully installed state.

In FIGS. 7A and 7B, a sealing member 126 for closing and sealing off a through opening 156 extending into a cooling gallery 122 of a piston (portion of piston 110 illustrated) constructed in accordance with another aspect of the invention is shown, wherein the same reference numerals, offset by a factor of 100, are used to identify like features. The piston body 112 is constructed substantially the same as discussed above for the body 12, and thus, repetition in describing the piston body 112 is believed unnecessary.

The sealing member 126 is provided as a rivet-style member, having a rivet body 74 and a rivet actuation member, also referred to as rivet mandrel 76. The rivet-style sealing member 126 is thus actuated to move from a first pre-installed state (FIG. 7A) to an expanded, plastically deformed second installed state (FIG. 7B) in the same manner as a common rivet. During installation, a shank 78 of the rivet body 74 is inserted through the non-threaded through opening 156 in a slight clearance fit, whereupon a portion of the shank 78 is extended upwardly into the cooling gallery 122 and an enlarged cap or head 79, having a larger diameter than the through opening 156, is brought into abutment with an underside of the floor 158, and then, a suitable rivet actuation tool (not shown) grasps the exposed, free end of the rivet mandrel 76 depending from the floor 158 to pull the rivet mandrel 76 relative to the rivet body 74, as is known in deploying rivets, thereby plastically deforming and expanding a portion of the shank 78 of the rivet body 74 into a permanent interference fit with an outer periphery of the through opening 156 an upper surface of the floor 158 to sealingly close off the through opening 156. It is contemplated, if desired, to facilitate forming a gas/fluid tight seal upon plastically deforming the shank 78 to its expanded form, a high temperature anaerobic sealant material 82 could be disposed about the shank 78 of the rivet body 74 prior to disposing the rivet body 74 into the through opening 156.

Figure 8A:
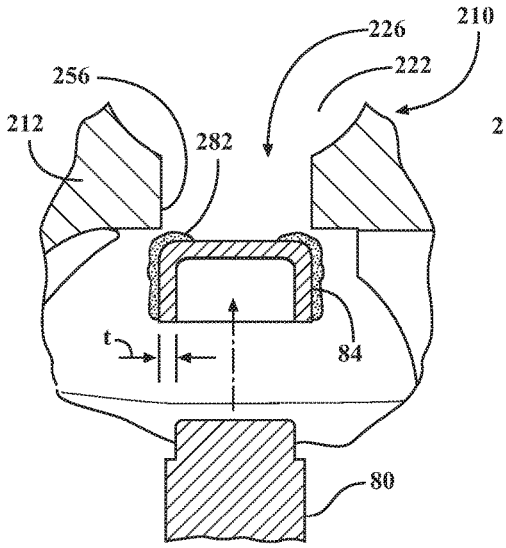
FIG. 8A is a cross-sectional elevation view of a sealing member in accordance with another aspect of the invention shown in an uninstalled state.
Figure 8B:
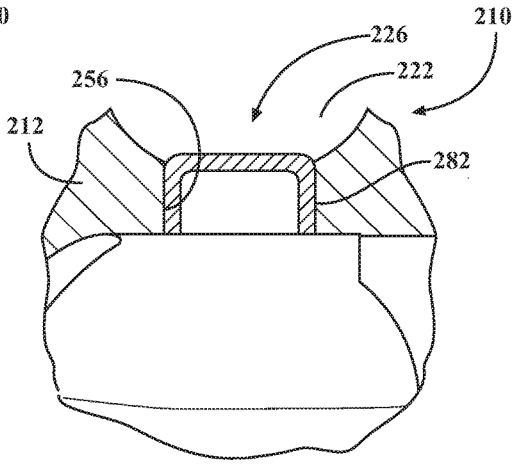
FIG. 8B is a cross-sectional elevation view of the sealing member of FIG. 8A shown in an installed state.

In FIGS. 8A and 8B, a sealing member 226 for closing off a through opening 256 extending into a cooling gallery 222 of a piston (portion of piston 210 illustrated) constructed in accordance with another aspect of the invention is shown, wherein the same reference numerals, offset by a factor of 200, are used to identify like features. The piston body 212 is constructed substantially the same as discussed above for the body 12, and thus, repetition in describing the piston body is believed unnecessary.

The sealing member 226 is provided as a cup-shaped plug. During installation, a closed end of the plug 226 is pressed into the through opening 256 in an interference fit with a suitable installation tool 80 received in and pressing against an open end of the plug 226 to sealingly close off the through opening 256. Preferably, to facilitate forming a gas/fluid tight seal, a high temperature anaerobic sealant material 282 is first disposed about an outer periphery 84 of the plug 226 prior to disposing the plug 226 into the through opening 256. The plug 226 can be formed having any suitable diameter to provide the desired interference fit within the through opening 256, taking into account the material and wall thickness (t) of the plug 226.

Figure 9A:
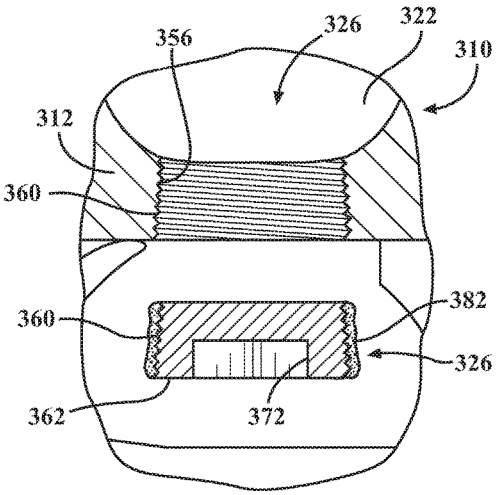
FIG. 9A is a cross-sectional elevation view of a sealing member in accordance with another aspect of the invention shown in an uninstalled state.
Figure 9B:
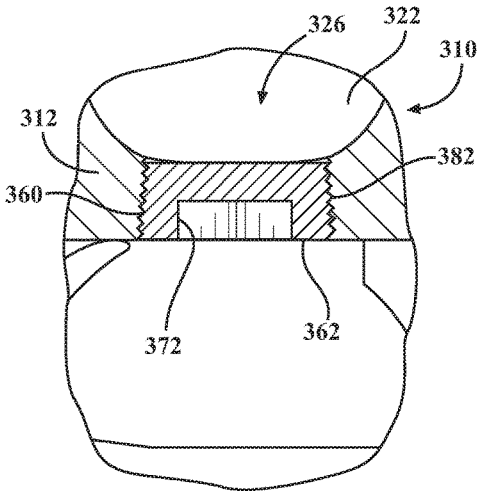
FIG. 9B is a cross-sectional elevation view of the sealing member of FIG. 9A shown in an installed state.

In FIGS. 9A and 9B, a tapered sealing member 326 for closing and sealing off a through opening 356 extending into a cooling gallery 322 of a piston (portion of piston 310 illustrated) constructed in accordance with another aspect of the invention is shown, wherein the same reference numerals, offset by a factor of 300, are used to identify like features. The piston body 312 is constructed substantially the same as discussed above for the body 12, and thus, repetition in describing the piston body 312 is believed unnecessary.

The tapered sealing member 326 is provided as a tapered threaded member, having a tapered male threaded shank 360. During installation, the tapered threaded shank 360 is threaded into a matching tapered female threaded through opening 356 to sealingly close off the tapered threaded through opening 356. The matching inclination of the tapers of the threaded shank 360 and the threaded opening 356 automatically cause the sealing member 326 to be driven to a set depth, and prevent the sealing member 326 from being over driven completely through the through opening 356. Preferably, to facilitate forming a gas/fluid tight seal, a high temperature anaerobic sealant material 382 is first disposed about an outer periphery of the threaded shank 360 prior to threading the threaded shank 360 into the threaded through opening 356. To facilitate rotatably driving the sealing member 326 into the threaded through opening 356, an end 362 of the member 326 can be provided with a drive feature 372, shown as a non-circular, hexagonal recessed pocket, by way of example and without limitation, for receipt of a similarly shaped drive tool. It should be recognized, as discussed above, that the pocket 372 could take a different; non-circular shaped, as desired, and further, could be formed as a male protrusion, if desired. In accordance with one aspect of the invention, the tapered threaded shank 360 is threaded into the tapered threaded through opening 356 to a torque between about 18-22 Nm, which has been found, in combination with the anaerobic sealant material 382, to optimally close off and seal the through opening 356 for the intended life of the piston 310.

Obviously, many modifications and variations of the present invention are possible in light of the above teachings. It is, therefore, to be understood that within the scope of the appended claims, the invention may be practiced otherwise than as specifically described.

What is claimed is:

1. A piston for an internal combustion engine, comprising:

a piston body including an upper part and a lower part bounding an annular cooling gallery, said upper part having an upper combustion surface configured for direct exposure to combustion gases within a cylinder bore and an undercrown surface beneath said upper combustion surface and having a ring belt region radially outwardly from said annular cooling gallery, said lower part providing a floor of said annular cooling gallery and a pair of pin bosses depending from said floor, said pin bosses having axially aligned pin bores, with said floor being disposed adjacent said ring belt region between said undercrown surface and said pin bosses and extending radially inwardly from said ring belt region so that said annular cooling gallery is located only above said pin bores, and said floor having a through opening;

a coolant medium disposed in said annular cooling gallery; and a sealing member hermetically sealing off said through opening and hermetically sealing said coolant medium in said coolant gallery.

2. The piston of claim 1 wherein said sealing member is fixed to said floor via one of a plastically expanded portion of said sealing member or a friction weld joint.

3. The piston of claim 2 wherein said sealing member is friction welded via said friction weld joint to an underside of said floor.

4. The piston of claim 3 wherein said sealing member has a conical surface friction welded to said underside of said floor.

5. The piston of claim 2 wherein said sealing member is an expanded rivet.

6. The piston of claim 1 further including a sealant material disposed about an outer periphery of said sealing member.

7. The piston of claim 1 wherein said through opening is formed on a non thrust side of said piston body.

8. The piston of claim 7 wherein said through opening is formed generally between said piston bosses.

9. The piston of claim 1 wherein said sealing member has a threaded shank threaded into said through opening.

10. The piston of claim 9 wherein said threaded shank is tapered and said through opening is tapered.

11. The piston of claim 9 further including a sealant material disposed about an outer periphery of said threaded shank.

12. A method of constructing a piston for an internal combustion engine, comprising:

forming a piston body including an upper part and a lower part, the upper part having an upper combustion surface configured for direct exposure to combustion gases within a cylinder bore and an undercrown surface beneath the upper combustion surface;

forming a ring belt region configured for receipt of at least one piston ring adjacent the upper combustion surface;

forming an annular cooling gallery radially inwardly from the ring belt region, the annular cooling gallery having a floor, the lower part including pin bosses depending from the floor, the pin bosses having axially aligned pin bores, with the floor being disposed adjacent to the ring belt region and spaced from the undercrown surface and between the undercrown surface and the pin bosses, the floor extending radially inwardly from the ring belt region so that the annular cooling gallery is located only above the pin bores;

forming a through opening in the floor of the cooling gallery;

disposing a coolant medium in the cooling gallery through the through opening; and disposing a sealing member in the through opening to hermetically seal the coolant medium in the cooling gallery.

13. The method of claim 12 further including friction welding the sealing member to an underside of said floor of the cooling gallery.

14. The method of claim 13 further including providing the sealing member having a conically tapered surface and friction welding the conically tapered surface to the underside of the floor.

15. The method of claim 12 further including providing the sealing member as a rivet and expanding the rivet in the through opening.

16. The method of claim 12 further including providing the sealing member as a plug and pressing the plug in the through opening.

17. The method of claim 16 further including disposing a sealant material about an outer periphery of the plug prior to pressing the plug in the through opening.

18. The method of claim 12 further including forming the through opening on a non-thrust side said piston body.

19. The method of claim 12 further including providing the sealing member having a threaded shank and threading the threaded shank in the through opening.

20. The method of claim 19 further including providing the sealing member having a tapered threaded shank and forming the through opening having a matching taper to the threaded shank and threading the tapered threaded shank into the tapered through opening.

21. The method of claim 20 further including disposing a sealant material about an outer periphery of the threaded shank prior to threading the threaded shank in the through opening.

22. The piston of claim 1 wherein said floor includes an interior wall extending generally parallel to said ring belt region and presenting said through opening, said sealing member extends from a first free end disposed in said sealed coolant gallery to a second free end, a portion of said sealing member tapers toward said first free end and is spaced from said interior wall of said through opening, and said sealing member has a generally cylindrical shape engaging said interior wall of said floor and extending along said through opening between said tapered portion and said second free end.

23. The method of claim 12 wherein the floor includes an interior wall extending generally parallel to the ring belt region and presenting the through opening, the sealing member extends from a first free end disposed in the sealed coolant gallery to a second free end, a portion of the sealing member tapers toward the first free end and is spaced from the interior wall of the through opening, and the sealing member has a generally cylindrical shape engaging the interior wall of the floor and extending along the through opening between the tapered portion and the second free end.

* * * * *